US005927672A

United States Patent [19]

Ruff

[11] Patent Number: 5,927,672

[45] Date of Patent: Jul. 27, 1999

[54] CARD HOLDER

[75] Inventor: Kenneth A. Ruff, Libertyville, Ill.

[73] Assignee: Jim Beam Brands Co., Deerfield, Ill.

[21] Appl. No.: 08/848,254

[22] Filed: Apr. 29, 1997

[51] Int. Cl.[6] ..... A47B 97/04

[52] U.S. Cl. ..... 248/452; 248/447; 40/530

[58] Field of Search ..... 248/452, 441.1, 248/444.1, 447, 451, 459, 460, 462; 40/530, 119

[56] References Cited

U.S. PATENT DOCUMENTS

| | | | |
|---|---|---|---|
| 620,211 | 2/1899 | Aikin . | |
| 1,008,509 | 11/1911 | Wilson . | |
| 1,037,292 | 9/1912 | Morden . | |
| 1,109,035 | 9/1914 | Buie . | |
| 1,148,742 | 8/1915 | Bernstein . | |
| 1,452,861 | 4/1923 | Wilburger . | |
| 2,014,267 | 9/1935 | Sherman | 248/447 |
| 2,091,260 | 8/1937 | Farkas et al. | 248/447 |
| 2,229,012 | 1/1941 | Geyzer | 40/530 |
| 2,380,780 | 7/1945 | Novak | 40/530 |
| 2,582,953 | 1/1952 | Bender | 129/1 |
| 3,090,143 | 5/1963 | Arnold | 40/119 |
| 4,178,710 | 12/1979 | Schmid | 40/530 |
| 4,239,410 | 12/1980 | Pianta | 402/20 |
| 4,365,434 | 12/1982 | Doyel | 40/530 |
| 4,429,901 | 2/1984 | Clery, Jr. et al. | 282/29 |
| 4,511,274 | 4/1985 | Chen | 402/21 |
| 4,544,123 | 10/1985 | Peacock | 248/460 |
| 4,709,895 | 12/1987 | Mardak | 248/460 |
| 4,867,594 | 9/1989 | Poulouin | 402/70 |
| 4,925,143 | 5/1990 | Sandmeyer | 248/451 |
| 5,005,796 | 4/1991 | Downie | 248/451 |
| 5,451,025 | 9/1995 | Hames | 248/452 |
| 5,535,976 | 7/1996 | Gruneisen, III | 248/452 |

FOREIGN PATENT DOCUMENTS

| | | |
|---|---|---|
| 287164 | 3/1953 | Switzerland . |

*Primary Examiner*—Ramon O. Ramirez
*Assistant Examiner*—Anita M. King
*Attorney, Agent, or Firm*—Pennie & Edmonds LLP

[57] ABSTRACT

A card holder having a spring biased, card-holding clamp and a support with first and second side members that are attached to each other at the top of the support. Each side member extends downwardly and outwardly with respect to each other, defining an angle therebetween. Ends of the clamp are mountable on the side members below a first stop and between second stops disposed on at least one of the side members. The spring-biased clamp and outwardly extending side members cooperatively bias the clamp upwardly. The first stop prevents upwardly movement of the clamp beyond a predetermined vertical position, and the second stops prevent movement of the clamp beyond preselected horizontal locations.

15 Claims, 5 Drawing Sheets

CARD HOLDER

BACKGROUND OF THE INVENTION

The present invention relates to card holder, such as a menu cardholder.

Restaurants frequently display menus in card holders that are placed on tables. Customers may refer to these displayed menus at any time during their stay at the restaurant, even after a waiter has removed their main menu. Often, these displayed card-menus list products different than those listed in the main menu and may catalog items such as drinks, deserts, or other specialty items.

Due to limited space on typical tabletops, it is desirable that card holders be compact, and because menus may change frequently, they should be easy to replace. Also, many menu cards are printed on both sides so they may be viewed from either side of the holder. It is therefore desirable that a card holder be able to present cards equally well from either of its sides. It is also desirable to display cards at an angle to the vertical because card holders are usually placed below the eye level of customers sitting at the table. Thus, cards that are angled upwardly are easier to read.

U.S. Pat. No. 5,535,976 discloses card holder with a base and a single vertical support member. Opposing ends of a clip fit into parallel grooves disposed on the sides of the support near the support's top. Cards with a slot near one of their ends fit onto the clip and hang therefrom when the clip is engaged in the grooves.

The support disclosed in the '976 patent may stand vertically or at an angle to the vertical. Either way, cards hanging on at least one side of the support will hang vertically, instead of at a more comfortable viewing angle.

The teaching partially remedies this by providing wings that extend from the support to the sides to display the cards at the desired angle. These wings, however, can hold a card at an angle only if the card is sufficiently rigid to rest on a wing without bending. Soft cards would merely bend around the wing, becoming more difficult to read. Furthermore, protruding wings are relatively fragile and increase manufacturing difficulties.

The '976 patent also discloses differently shaped supports, such as S-shaped supports. Different portions of the S, however, would have the similar disadvantages as the wings when supporting cards.

To remove the clip from the grooves, a user must pull the clip open, spreading clip's ends and extracting them from the grooves. This manoeuver requires two hands to execute with relative ease and risks placing excessive force on the clip if the user is not cautious.

The prior art does not provide an easily loadable and unloadable card holder that can fully support cards at an angle on more than one side of the holder.

SUMMARY OF THE INVENTION

The invention is a card holder in which cards may be easily loaded and unloaded. The card holder has a card-holding, spring-biased clamp and a support. The support has a base connected to the bottom of two side members that are joined together at the top of the support and that extend downwardly and outwardly with respect to each other. A first, upper stop protrudes from each side member, preferably in the form of a horizontal ridge.

The clamp has a C-shaped intermediate section that connects two clamp ends and that is extendable through mounting holes in a group of cards. These ends are mountable on the outwardly extending side members of the support below the ridge. The spring bias of the clamp and the angle formed between the side members cooperate to bias the clamp upwardly towards the ridge. The ridge, in turn, prevents upward movement of the clamp ends beyond the ridge, when the ridge and the ends abut.

The support also preferably has a pair of second, side stops protruding from a side member adjacent the ridge. When a clamp end is mounted between the side stops, these retain the clamp positioned therebetween, preventing horizontal movement beyond either side stop.

The clamp is additionally provided with guide flanges attached to the clamp ends. When the clamp is pressed downwardly onto the support, against the top of the support and the ridges, the guide flanges are biased outwardly by the structures on the support, expanding the clamp so its ends may be slid into a mounted position on the side members and below the ridges.

As a result, cards may be fitted onto the clamp, and the clamp may be slid onto the support in a single motion. Once the clamp is mounted on the support, the ridges, side stops, and the angled orientation of the side members retain the clamp on a predetermined part of the side members. To release the clamp from the support, the clamp is pushed down, so that clamp ends are below the side stops, and then slid sideways off the support. The card holder thus does not require accurate mounting of the clamp and enables easy removal of the clamp from the support. Furthermore, the side members preferably extend to the base at a substantially constant angle, to provide additional support along the length of cards hanging from the clamp at an angle to the vertical.

DETAILED DESCRIPTION OF THE PREFERRED EMBODIMENTS

Figure 1:
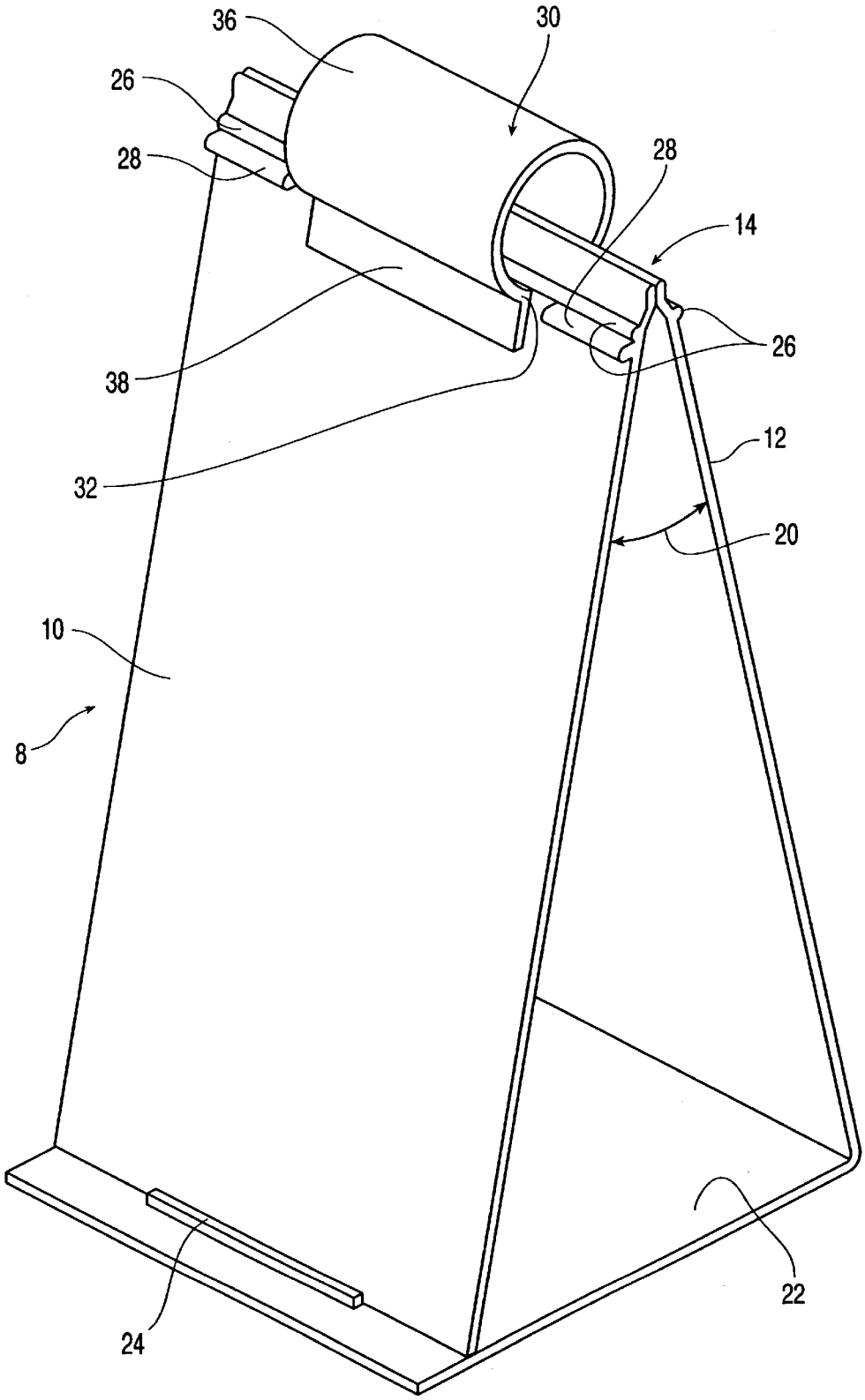
FIG. 1 shows a perspective of a preferred embodiment of a card holder according to the invention.

Referring to FIG. 1, a card holder of the preferred embodiment has a support 8 with first and second side members 10 and 12 that are attached to each other at the top end 14 of the support 8. Although the end 14 is referred to as the top of the support 8, it will be understood that the orientation of the embodiment's structure is immaterial.

Each side member 10 and 12 extends downwardly and outwardly with respect to the other, defining an angle 20 between them. Angle 20 is preferably acute, more preferably between about 20° and 30°, and most preferably 26°. The angle 20 is sufficient to upwardly bias an object clamped against side members 10 and 12. This angle 20 is also selected to provide an ideal angle, with respect to a table on which the card holder in placed, from which to display cards supported by the card holder.

The side members 10 and 12 are made from a plastic material and are sonically welded to each other.

Alternatively, the side members 10 and 12 may be attached by any suitable means such as by fasteners, cementing, or by simply manufacturing them from a single piece of material.

The support 8 includes a base 22 that joins the side members 10 and 12. The base 22 and the second side member 12 are formed from one piece of material. As shown, side members 10 and 12 preferably extend outwardly from the top 14 of the support 8 to the base 22 and are wide enough to support most of the width of a card leaning against them.

A lip 24 protrudes from the base 22 towards the first side member 10. A bottom end of the first side member 10 rests against the base 22, and the lip 24 keeps the first side member 10 from sliding beyond the lip 24. Lip 24 is preferably strong enough to withstand normal forces applied to the top 14 of the support 8 that would otherwise tend to collapse the support 8 as the two side members 10 and 12 spread apart from each other, potentially severing one from another.

In an alternative embodiment, a tab on one or each side member 10 and 12 can be provided for fitting into a corresponding slot in the base 22. This tab may be secured within the slot.

Each side member 10 and 12 has a first, upper stop, which in the preferred embodiment is a horizontal ridge 26 disposed on the side members 10 and 12, near the top 14 of the support 8. The upper stops prevent a clamp from sliding upwardly beyond a preselected position. Therefore, other suitable upper stops comprise one or more protrusions extending from both or either side member 10 and 12. A ridge 26 on only one of the side members 10 or 12, for example, is practicable in most applications.

The support 8 further has second, side stops 28 that protrude from the first side member 10 adjacent and below its ridge 26. Side stops 28 are spaced from each other enough to receive a card holding clamp therebetween.

Figure 4:
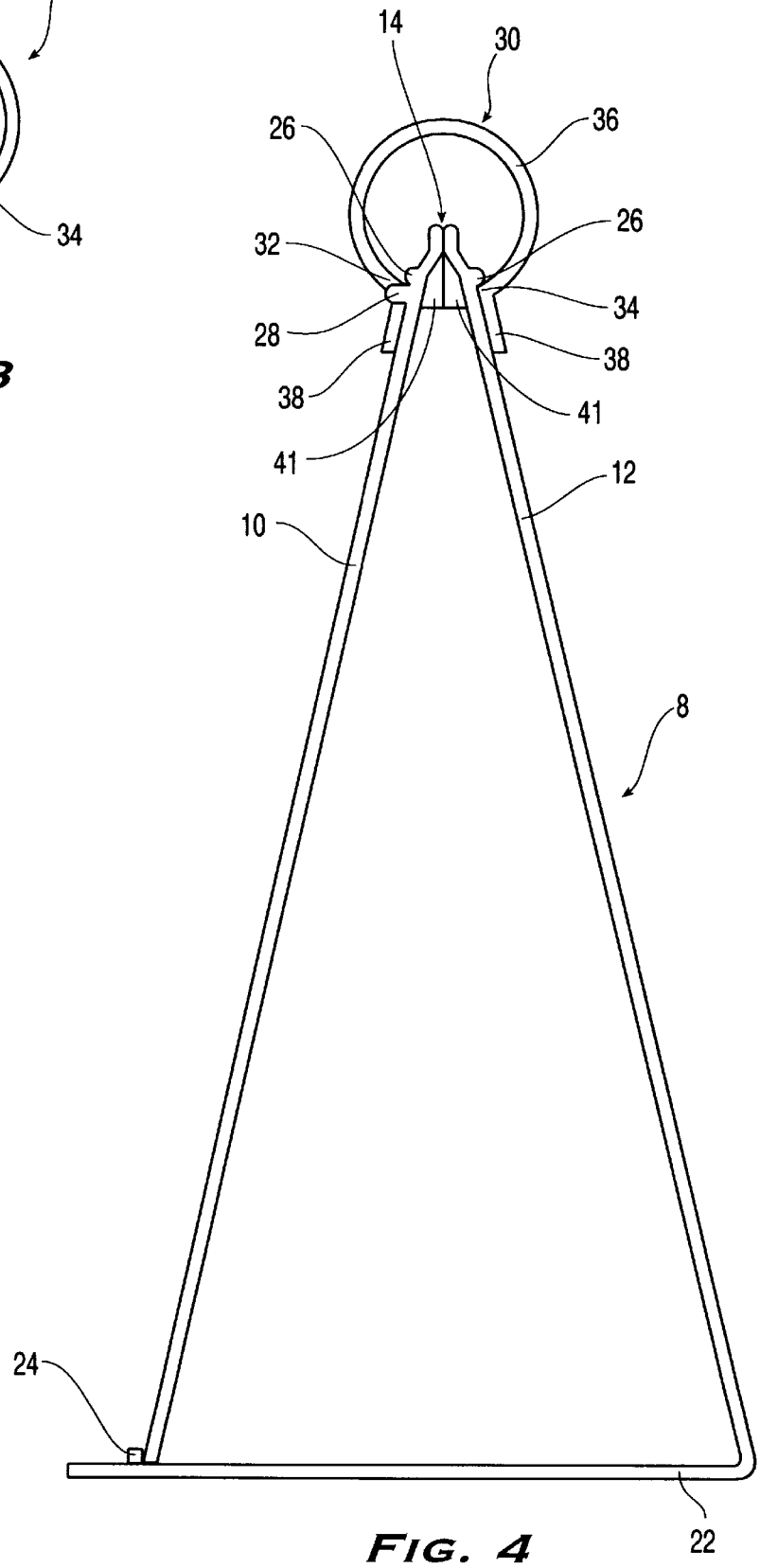
FIG. 4 is side view of a clamp according to the invention in its natural state, when it is off a support.

Referring to FIGS. 1–4, a card-holding clamp 30 according to the invention is mounted on the support 8. The clamp 30 has first and second clamp ends 32 and 34 and a spring biased intermediate section 36 connecting the clamp ends 32 and 34 together. The intermediate section 36 has a C-shaped cross-section. The term "C-shaped" herein collectively refers to shapes that can extend from the first side member 10 the second side member 12 below the ridges 26. Thus, this term includes square, triangular, and other cross-sectional shapes. When the clamp 30 is not mounted on the support 8, as shown in FIG. 4, it has a naturally assumed position in which the spacing 37 between the clamp ends 32 and 34 is smaller than the spacing between the ends 32 and 34 when the clamp is mounted on the support 8. Also, the spacing between the clamp ends 32 and 34 when the clamp 30 is mounted on the support 8 is preferably less than the spacing of the sides of the support 8 from one side 10 to the other 12, at a location just below the ridges 26.

The spring biased intermediate section 36 of the clamp 30 biases the clamp ends 32 and 34 against the outwardly extending side members 10 and 12. The clamp ends 32 and 34 are thus biased by the side members 10 and 12 towards the top 14 of the support 8, in the direction in which the spread narrows between these members 10 and 12. The ridges 26 prevent the clamp ends 32 and 34 from sliding beyond a predetermined position in which the ends 32 and 34 abut the ridges 26. Consequently, the clamp ends 32 and 34 are retainable against the side members 10 and 12, at a location below the ridges 26.

From each clamp end 32 and 34 extends a guide flange 38. The guide flanges 38, the side members 10 and 12, and the ridges 26 cooperate so that when the clamp 30 is pressed downwardly against the top 14 of the support 8, the guide flanges 38 are biased outwardly by the side members 10 and 12 and by the ridges 26, expanding the clamp 30 such that its ends 32 and 34 may slide or snap beyond the ridges 26 and into the illustrated mounted position. Preferably, the clamp 30 may be pressed downwardly on the support 8 until the intermediate section 36 of the clamp 30 abuts the top 14 of the support 8, preventing further downward motion. Then the clamp 30, under its own spring bias engagement against the angled side members 10 and 12, will slide upwardly unassisted until it abuts the ridges 26. In the preferred mounted position, the clamp ends 32 and 34 sit against the ridges 26 and flush against the first and second side members 10 and 12.

Figure 5:
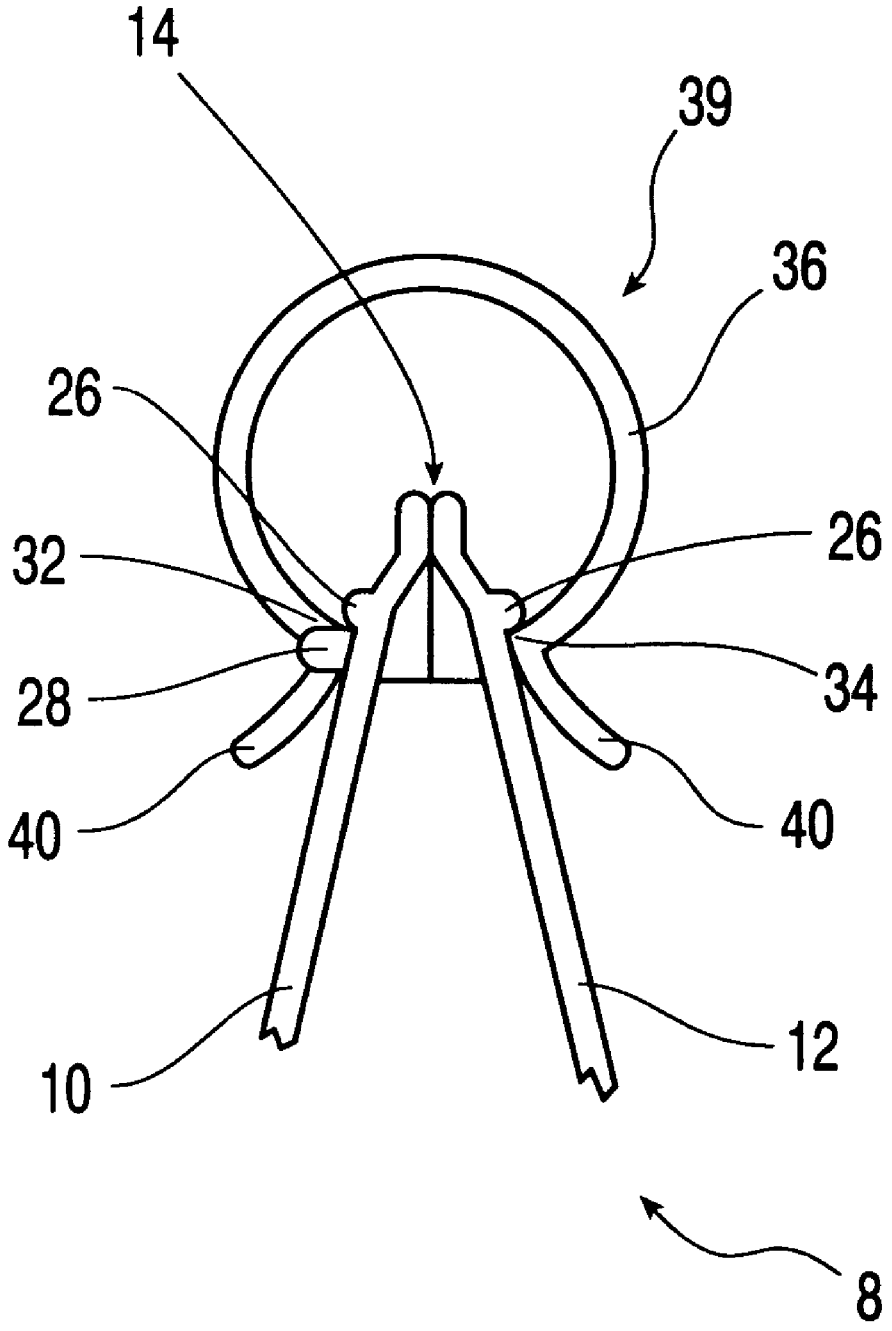
FIG. 5 illustrates an alternative embodiment of a clamp mounted on a support according to the invention.

FIG. 5, shows an alternative embodiment of the clamp 39 mounted on the support 8. In this embodiment, the guide flanges 40 of clamp 39 remain at an angle to the side members 10 and 12. They are also curved and have rounded lower tips to further facilitate mounting the clamp 39 on the support 8.

Side stops 28 protrude sufficiently from the first side member 10 to keep the clamp 30 from sliding laterally, or sideways, off the support 8 when the clamp 30 is disposed in its mounted position against the ridges 26. The ridges 26 and side stops 28 of the embodiment of FIG. 1 protrude by about an equal amount, whereas, in the embodiment of FIG. 3, the side stops 28 protrude further than the ridges 26, by an amount approximately equal to the cross-sectional thickness of the of the clamp 30.

The embodiment of FIG. 1 has no webs 41, and instead, the side members 10 and 12 are attached on flat, inner surfaces at the tops of the side members 10 and 12. The embodiment of FIGS. 3, 5 and 6, on the other hand, has a plurality of webs 41 lined along the inside of the support 8 near the top 14. These webs 41 increase the joining area between the side members 10 and 12 and improve the general stiffness and strength of the support 8.

Figure 6:
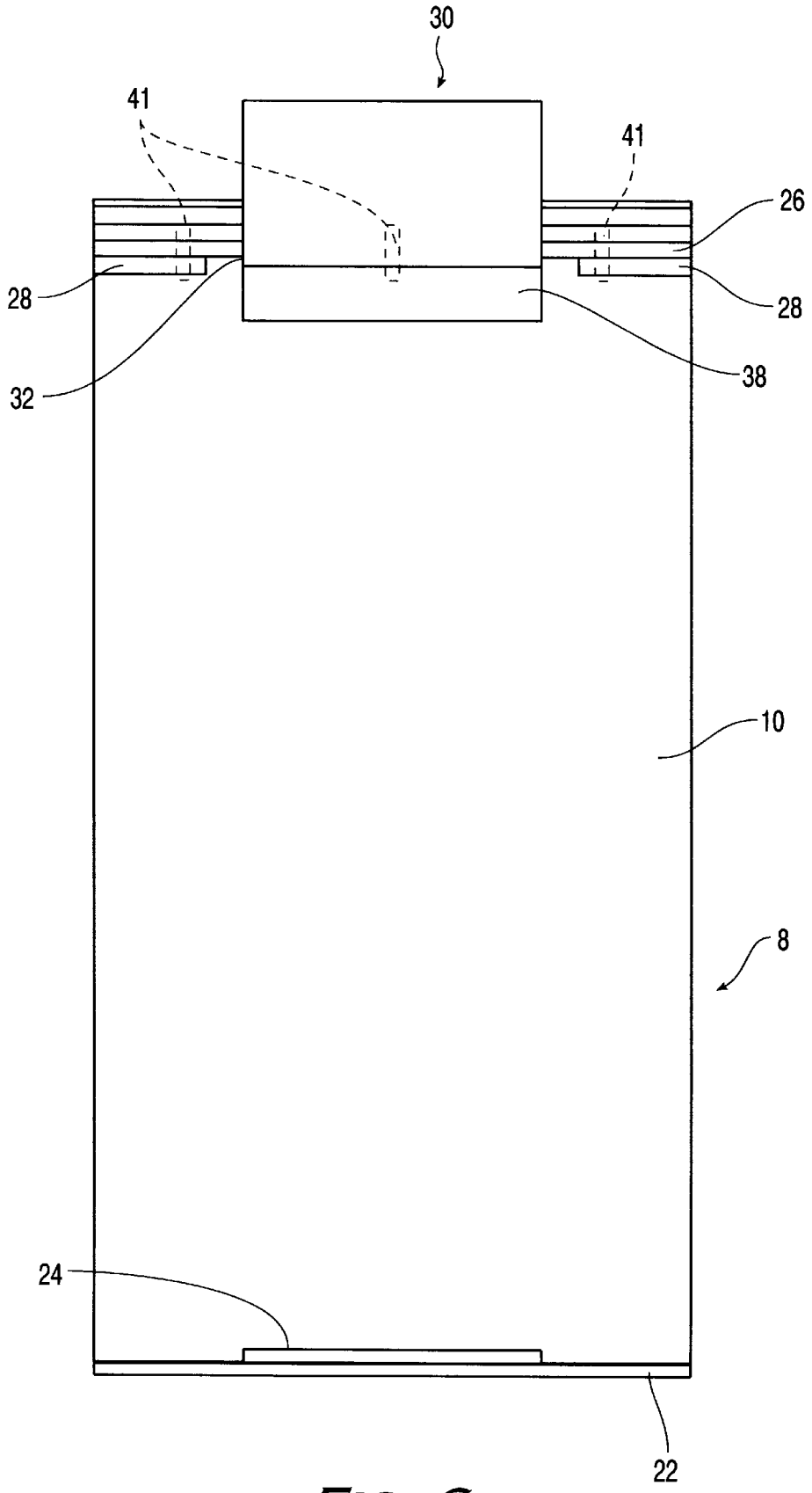
FIG. 6 displays an elevation view of the card holder of FIGS. 3 and 5.

As shown in FIG. 6, the side stops 28 of this embodiment are narrow in the vertical direction. As a result, a user can press downwardly on the mounted clamp 30, sliding clamp end 32 by at least predetermined distance from ridge 26, beyond the side stops 28, and then slide the clamp 30 laterally off the side members 10 and 12. The vertical width of the side stops 28 determines the required downward displacement of clamp ends 32 and 34 from the ridges 26 before the clamp 30 can be slid laterally beyond the side stops 28. The user may otherwise grasp the clamp 30 on two sides, spread the clamp ends 32 and 34 beyond the ridges 26, and remove the clamp 30 from the side members 10 and 12.

As illustrated, the side stops 28 are preferably spaced at a distance greater than the width of the clamp end 32 and its associated guide flange 38. This spacing allows the clamp 30 to be mounted to the support 8 without precisely locating the clamp 30 laterally with respect to the side stops 28. Narrower spacings between the side stops 28 further limit the range of horizontal or lateral movement of the clamp 30 over the side members 10 and 12.

Figure 2:
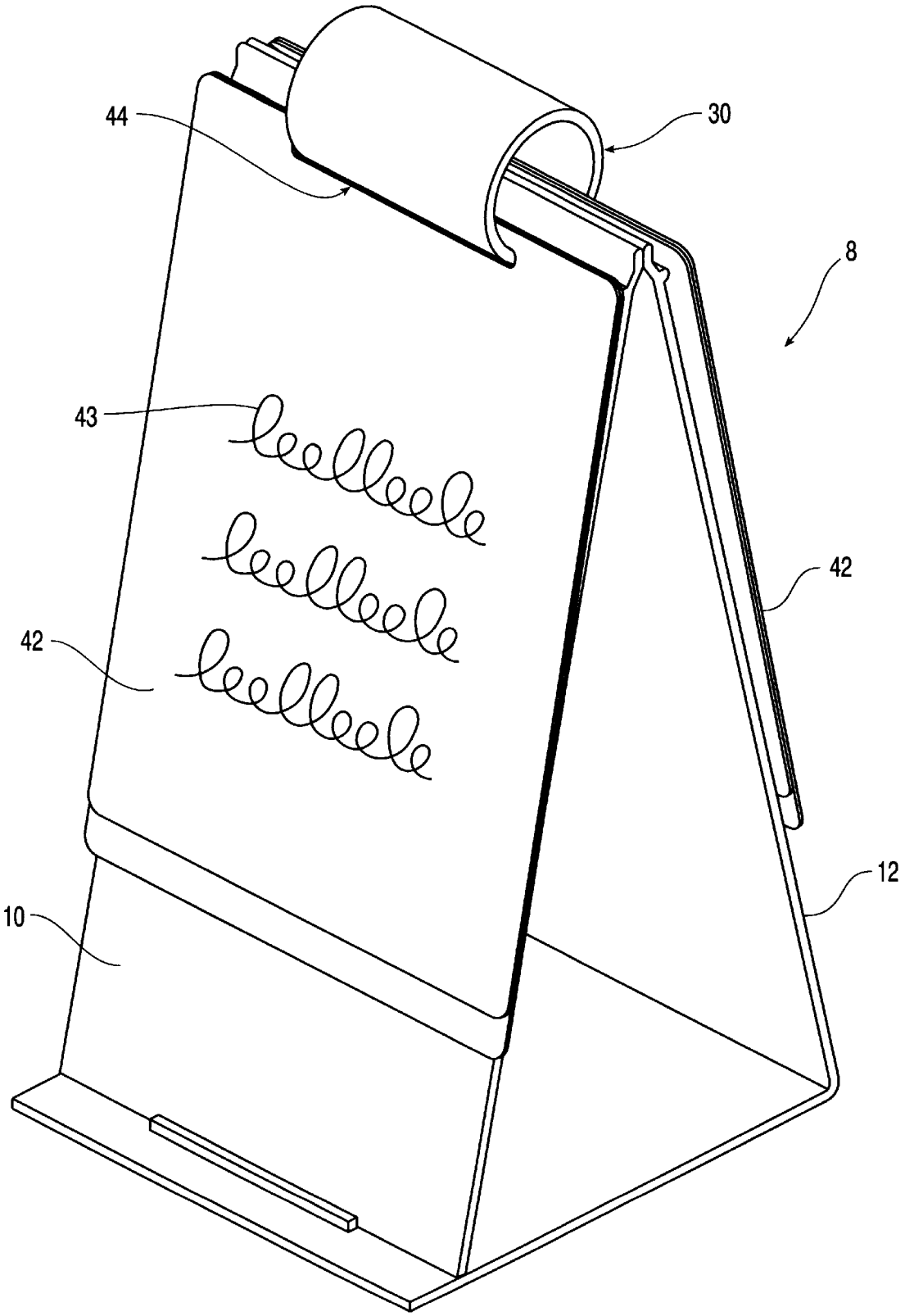
FIG. 2 is a perspective view of a card holder according to the invention holding a card.
Figure 3:
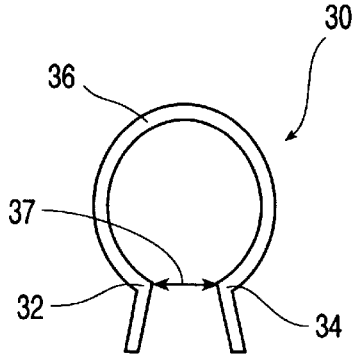
FIG. 3 illustrates a side view of a card holder according to the invention.

FIG. 2 shows the card holder holding cards 42 that contain printed material 43 on both sides. Clamp 30 is shaped to project through a mounting slot 44 in cards 42. The cards 42 rest against the side members 10 and 12 and may be flipped over the top 14 of the support 8, along the intermediate section 36 of the clamp 30, from one side member to the other 10 and 12. As stated above, side members 10 and 12 preferably have sufficient width to adequately support cards 42 that are soft enough to flex under their own weight. More rigid cards 42 may be supported on narrower side members 10 and 12. The cards 42 are shown with progressively increasing lengths such that, the bottom of each card is visible even while the upper portion of the card is covered by other cards 42.

It is preferred that the entire length of cards 42 rest against the outwardly extending side members 10 and 12. For this reason, the side members 10 and 12 and the base 22, preferably define a triangle. Side members that only extend downwardly and outwardly over a portion of the height of the older, such as from a vertical central support, are suitable for many applications.

What is claimed:

1. A card holder comprising:

a) a support having i) a first downwardly and outwardly extending side member having a top and a bottom, ii) a second downwardly and outwardly extending side member having a top and a bottom, and iii) a first stop disposed on at least one of said side members; and b) a card-holding clamp having two opposed ends and an intermediate C-shaped section connected between the ends for holding a plurality of cards, each card having a mounting slot through which said intermediate section is extendable, the clamp being positionable over the tops of said side members with the opposed ends engaging respectively against the side members at a location below said first stop, wherein said first stop is configured to prevent upward movement of the clamp beyond a predetermined vertical position, and the first and second side members extend at an angle with respect to each other for biasing the clamp ends upwardly towards the first stop.

2. The card holder of claim 1, wherein said first stop is disposed adjacent the top of at least one of said side members.

3. The card holder of claim 2, wherein the opposed ends are spring biased against the side members.

4. The card holder of claim 3, wherein the first stop includes a first stop disposed on each side member, each first stop comprising a ridge.

5. The card holder of claim 3, wherein the clamp has a naturally assumed position when off the support, in which the ends are separated by a first distance, and the sides of the support, immediately below the first stop, are spaced from each other by a distance which is greater than said first distance.

6. The card holder of claim 3, wherein the support further comprises a base attached to the bottoms of said side members, said side members and the base defining a triangle.

7. The card holder of claim 6, wherein said side members extend outwardly substantially to the base.

8. The card holder of claim 7, wherein said angle between the side members is between about 20° and 30°.

9. The card holder of claim 3, wherein the clamp has a naturally assumed position when off the support, in which the ends are separated by a first distance, and a mounted position when the clamp is mounted on the side members below said first stop, in which the ends are separated by a second distance, said second distance being greater than said first distance.

10. The card holder of claim 3, wherein the first stop is configured to prevent upward movement of the clamp beyond the predetermined vertical position when at least one of the opposed ends abuts the first stop.

11. The card holder of claim 1, wherein the intermediate section of the clamp has an inner surface that is unobstructed between the opposed ends to permit the cards to be mounted thereon and flipped from a position adjacent one of the side members to a position adjacent the other of the side members.

12. A card holder comprising:

a) a support having a top and a bottom and i) a first downwardly and outwardly extending surface, ii) a second downwardly and outwardly extending surface, and iii) a first stop disposed adjacent to at least one of the first and second surfaces; and b) a card-holding clamp having two opposed ends and an intermediate section connected between the ends for holding a plurality of cards that have mounting slots through which the intermediate section is extendable, the clamp being positionable over the top of the support with the opposed ends engaging respectively against the first and second surfaces at a location below the first stop;

wherein the first and second surfaces extend at an angle with respect to each other for biasing the clamp ends upwardly towards the first stop, and the first stop is configured to prevent upward movement of the clamp beyond a predetermined vertical position.

13. The card holder of claim 12, further comprising a second stop associated with at least one of the first and second surfaces for preventing movement of the clamp beyond a preselected horizontal location.

14. The card holder of claim 12, wherein the clamp includes a guide flange extending from said ends and cooperating with the first stop to expand the clamp when said guide flanges are pressed downwardly over the top of the support and against said first stop.

15. The card holder of claim 12, wherein the first and second surfaces are configured for cooperatively slidably bias the clamp ends upwardly towards the first stop.

* * * * *